United States Patent [19]

Adam

[11] 4,281,261

[45] Jul. 28, 1981

[54] INTEGRATED IGFET CONSTANT CURRENT SOURCE

[75] Inventor: Fritz G. Adam, Freiburg, Fed. Rep. of Germany

[73] Assignee: ITT Industries, Inc., New York, N.Y.

[21] Appl. No.: 40,801

[22] Filed: May 21, 1979

[30] Foreign Application Priority Data

Jun. 19, 1978 [DE] Fed. Rep. of Germany ..... 2826624

[51] Int. Cl.[3] ..... H03K 3/01

[52] U.S. Cl. ..... 307/270; 307/297; 307/304; 323/315

[58] Field of Search ..... 307/297, 270, 304; 323/4.9, 22 R

[56] References Cited

U.S. PATENT DOCUMENTS

| | | | |
|---|---|---|---|
| 3,832,644 | 8/1974 | Nagata et al. | 323/22 R |
| 3,875,430 | 4/1975 | Prak | 307/304 |
| 3,996,482 | 12/1976 | Lockwood | 307/297 |
| 4,016,431 | 4/1977 | Henle et al. | 307/270 |

*Primary Examiner*—H. Dixon

*Attorney, Agent, or Firm*—John T. O'Halloran; Peter C. Van Der Sluys

[57] ABSTRACT

The circuit of the current source comprises two enhancement IGFET pairs connected in series and one enhancement current source IGFET. All of the IGFETs show the same conductivity (p-channel or n-channel) and the two IGFET pairs are connected between the supply voltage and the substrate. The common connection point of the first IGFET pair is connected to the gate electrode of the substrate IGFET of the second IGFET pair and the common connection point of the second IGFET pair is fed to the gate of the current source IGFET.

4 Claims, 1 Drawing Figure

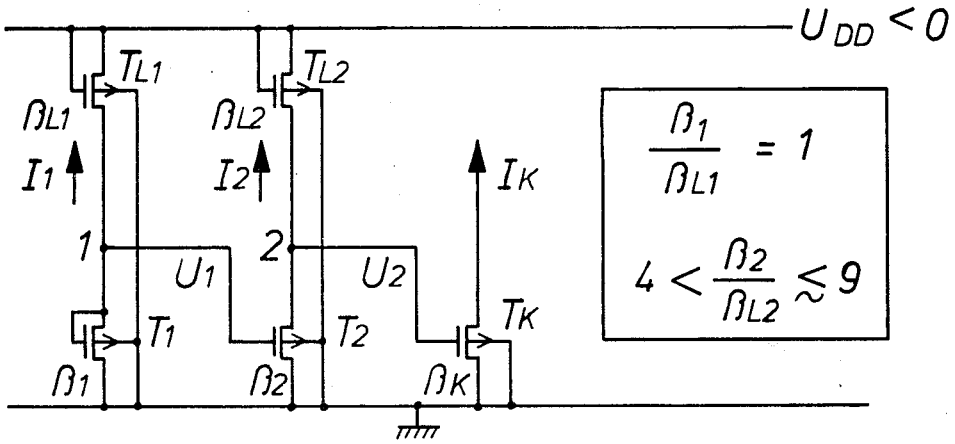
$U_{DD} < 0$
$T_{L1}$
$T_{L2}$
$\beta_{L1}$
$\beta_{L2}$
$I_1$
$I_2$
$I_K$
1
2
$U_1$
$U_2$
$T_1$
$T_2$
$T_K$
$\beta_1$
$\beta_2$
$\beta_K$
$\frac{\beta_1}{\beta_{L1}} = 1$
$4 < \frac{\beta_2}{\beta_{L2}} \lesssim 9$

INTEGRATED IGFET CONSTANT CURRENT SOURCE

BACKGROUND OF THE INVENTION

This invention relates in general to a monolithically integrated circuit for an IGFET constant current source. The circuit of an IGFET constant current source containing a source-drain series arrangement of two IGFET's (insulated-gate field-effect transistors) of one conductivity type in series between the voltage supply and the substrate, in which circuit the gate electrode of the load IGFET of the series arrangement together with the first pole of the voltage supply and the common connection point of the two IGFET's is applied to the gate electrode of a further current source IGFET, by which the current to be switched constant, flows from or to the substrate is known from the German Published Patent Application (DE-OS) No. 25 02 689.

In this conventional IGFET constant current source the standard deviation values of the threshold voltages of the IGFET's are brought to a minimum in that there is acted upon the ratios of the width W to the length L of the channel regions. In this IGFET constant current source, however, the action of the substrate effect upon the threshold voltage has not been taken into consideration, and insulated islands would be necessary for avoiding the substrate effect.

This invention is based on the recognition that the threshold voltage $$|U_{Tp}| = |\phi_{M\,iSi}| + \frac{Q_{SS}}{Cos} + \left|\frac{Q_B(N_n, 2\phi_{Fn})}{Cox}\right| + |\phi_{Fn}(N_n)| \quad (1)$$

for P-channel IGFET's and $$|U_{Tn}| = \phi_{M\,iSi} - \frac{Q_{SS}}{Cox} + \left|\frac{Q_B(N_p, 2\phi_{Fp})}{Cox}\right| + |\phi_{Fp}(N_p)| \quad (2)$$

for N-channel IGFET's are chiefly subject to the variations of the surface charge density $Q_{SS}$. In the equations (1) and (2), as well as in the following equations the parameters have the following meanings:

$Q_{SS}$=Surface charge density $$\left[\frac{A\ \text{sec}}{\text{cm}^2}\right],$$

$$\beta = \mu C_{ox}\frac{W}{L}\left[\frac{A}{V^2}\right]$$

the mutual conductance constant, with

W=width of the channel region, and

L=length of the channel region, $C_{ox}$=specific capacitance of the gate electrode, $Q_B=\sqrt{2\epsilon_s qN\cdot 2\phi_F}$=space charge, $U_{DD}$=supply voltage, $U_{Tn}$, $U_{Tp}$=d.s. threshold voltages, $\Delta U_T$=variation of the threshold voltage owing to the substrate effect caused by variations in the surface charge density, $\phi_M$iSi=difference in the work functions between the gate electrode and the self-conducting silicon, $N_n$, $N_p$=original substrate surface doping concentration $$\phi_{Fp} = \frac{kT}{q}\ln\frac{N_p}{N_i} \text{ or } \phi_{Fn} = \frac{kT}{q}\ln\frac{N_n}{N_i}$$

and $N_i$=intrinsic charge density.

SUMMARY OF THE INVENTION

According to this invention there is provided a monolithically integrated circuit for an IGFET-constant current source containing a source-drain series arrangement of two IGFET's of one conductivity type in series between the voltage supply and the substrate, in which series arrangement the gate electrode of the first load IGFET of the series arrangement, as applied to the first pole of the voltage supply, is connected to the first pole of the voltage supply, and the common connection point of the two IGFET's is connected to the gate electrode of a current-source IGFET whose source electrode is applied to the substrate, wherein the improvement comprises that:

when using enhancement IGFET's of the same channel conductivity type, the gate electrode of the second IGFET ($T_2$) of the series arrangement is connected to the common connection point (1) of a further source-drain series arrangement of two IGFET's ($TL_1$, $T_1$) arranged in series between the first pole and the substrate that in the further source-drain series arrangement, the gate electrode of the load IGFET ($T_{L1}$) as applied to the first pole of the supply voltage ($U_{DD}$), is applied to this first pole of voltage supply ($U_{DD}$), and that the gate electrode of the second IGFET ($T_1$) is applied to the common connection point (1) thereof, and that the condition $$\frac{\beta\,1}{\beta\,L1} = 1$$

is extensively approximated, and that the condition $4<(\beta_2/L2)\leqq 9$ is satisfied, wherein $\beta_1$ indicates the mutual conductance constant of the second IGFET ($T_1$) of said further series arrangement, wherein $\beta_{L1}$ indicates the mutual conductance constant of the load-IGFET of said further series arrangement, wherein $\beta_2$ indicates the mutual conductance constant of the second IGFET ($T_2$) of the series arrangement, and wherein $\beta_{L2}$ indicates the mutual conductance constant of the load-IGFET of the series arrangement.

It is the object of this invention to further develop the circuit of the conventional IGFET constant current source, on one hand, for enabling the use of P-channel IGFET's and, on the other hand, for enabling the use of N-channel IGFET's, in order that the influence of the substrate effect (surface charge density $Q_{SS}$) can be completely eliminated, and to achieve a current stability of the current flowing through the current source IGFET, with respect to variations of the supply $U_{DD}$.

For solving the problem, this invention sets out from the basic idea of further developing the conventional circuit of an IGFET constant current source according to the aforementioned German Published Patent Application (DE-OS) No. 25 02 689, and of selecting certain ratios of the mutual conductance constants.

With respect to a monolithically integrated circuit for an IGFET constant current source according to the preamble of claim 1, employing either P-channel or N-channel IGFET's, the aforementioned problem, according to this invention, is solved by taking the circuit-technical measures and selecting the ratios of the mutual conductance constants as set forth in the characterizing part of claim 1.

BRIEF DESCRIPTION OF THE DRAWING

In the following, this invention will now be explained in greater detail with reference to the example of a channel constant current source according to this invention shown in the accompanying drawing relating to a monolithically integrated circuit.

DETAILED DESCRIPTION OF THE PREFERRED EMBODIMENTS

The circuit shown in the accompanying drawings, exclusively employs IGFET's of one channel conductivity type. It contains a first source-drain series arrangement of two IGFET's $T_{L2}$ and $T_2$ through which the current $I_2$ flows. The common connection point 2 of the series arrangement is applied to the gate electrode of the current source IGFET $T_K$ through which the current $I_K$ flows which is to be stabilized.

While the gate electrode of the load IGFET $T_{L2}$ is applied to the first pole of the voltage supply $U_{DD}$, the gate electrode of the other IGFET $T_2$ is connected to the common connection point 1 of a further source-drain series arrangement consisting of two IGFET's $T_{L1}$ and $T_1$. While the gate electrode of the load IGFET $T_{L1}$ of the further series arrangement is applied to the drain region, or to the first pole of the voltage supply $U_{DD}$, the gate electrode of the other IGFET $T_1$ of the further series arrangement is connected to the common connection point 1 of the further series arrangement.

In the drawing, there are shown next to the circuit, the conditions under which the $Q_{SS}$-influence can be completely eliminated in accordance with the following calculation. In practice, however, standard deviations of the mutual conductance constants occurring during manufacture, will have to be taken into account, so that these ideal values, as a rule, can only be extensively approximated.

The following calculation confirms that a circuit according to the drawing, has the property of completely eliminating the $Q_{SS}$-influence.

The $\beta$-relationships necessary to this end, result from the following calculation with a view to the parameters given in the drawing:

Calculation based on $U_1$ is as follows:

$$I_1 = \frac{\beta_1}{2}(U_1 - U_{T1})^2 = \frac{\beta_{L1}}{2}(U_{DD} - U_1 - U_{TL1} - \Delta U_{TL1})^2 \quad (3)$$

or $$b_1(U_1 - U_{T1}) = U_{DD} - U_1 - U_{TL1} - \Delta U_{TL1} \quad (4)$$

wherein $U_{T1}$ and $U_{TL1}$ indicate the threshold voltages, and $b_1$, $\Delta U_{TL}$ and $U_{BO}$ have the following meanings:

$$b_1 = \sqrt{\beta_1/\beta_{L1}'} \quad (5)$$

-continued $$\Delta U_{TL} = U_{BO}\left(\sqrt{1 + \frac{U_1}{2\phi_F}} - 1\right) \text{ and} \quad (6)$$

$$U_{BO} = \frac{1}{C_{ox}}\sqrt{2\epsilon_s q N \cdot 2\phi_F}\,. \quad (7)$$

From equations (6) and (4) there is obtained a quadratic equation for $U_1$:

$$U_1^2 - 2U_1\left(W_1 + \frac{U_{B1}^2}{4\phi_f}\right) + W_1^2 - U_{B1}^2 = 0 \quad (8)$$

$$\text{with } W_1 = \frac{1}{b_1 + 1}(U_{DD} + U_{BO} + b_1 U_{T1} - U_{TL1}) \quad (9)$$

with the solution:

$$U_1 = W_1 = \frac{U_{B1}^2}{4\phi_F}(\pm)\, U_{B1}\sqrt{1 + \frac{W_1}{2\phi_F} + \left(\frac{U_{B1}}{4\phi_F}\right)^2} \quad (10)$$

by using the abbreviation $$U_{B1} = \frac{U_{BO}}{b_1 + 1} \quad (11)$$

$U_2$ is calculated from:

$$I_2 = \frac{\beta_2}{2}(U_1 - U_{T2})^2 = \frac{\beta_{L2}}{2}(U_{DD} - U_2\, U_{TL2} - \Delta U_{TL2})^2 \quad (12)$$

as long as $T_2$ is in the state of saturation, that is, as long as $$U_1 - U_{T2} < U_2 \quad (12a)$$

Instead of (12) there also applies $$b_2(U_1 - U_{T2}) = U_{DD} - U_1 - U_{TL2} - \Delta U_{TL2} \quad (13)$$

with $$b_2 = \sqrt{\beta_2/\beta_{L2}} \text{ and} \quad (14)$$

$$\Delta U_{TL2} = U_{BO}\left(\sqrt{1 + \frac{U_2}{2\phi_F}} - 1\right) \quad (15)$$

From (13) and (15) there is obtained a quadratic equation for $U_2$:

$$U_2^2 - 2U_2\left(W_2 + \frac{U_{BO}^2}{4\phi_F}\right) + W_2^2 - U_{BO}^2 = 0 \quad (16)$$

with $$W_2 = U_{DD} + U_{BO} + b_2(U_{T2} - U_1) - U_{TL2} \quad (17)$$

and with the solution:

$$U_2 = W_2 + \frac{U_{BO}^2}{4\phi_F}(\pm)\, U_{BO}\sqrt{1 + \frac{W_2}{2\phi_F} + \left(\frac{U_{BO}}{2\phi_F}\right)^2} \quad (18)$$

With regard to the threshold voltages it is possible to write:

$$U_{TL1} = U_{TL2} = U_{TO} \quad (19a)$$

$$U_{T1} = U_{TO} \quad (19b)$$

$$U_{TL} = U_{TO} + \frac{Q_{I2}}{Cox} \quad (19c)$$

$$U_{TO} = U_{FB} + U_{BO} + 2\,\phi_F \quad (19d)$$

$$U_{FB} = \begin{cases} \phi_{MS} - \frac{Q_{SS}}{Cox} \text{ for } n\text{-channel} \\ \phi_{MS} + \frac{Q_{SS}}{Cox} \text{ for } p\text{-channel} \end{cases} \quad (19e)(19f)$$

with the term $Q_{12}$ relating to the case in which by way of ion implantation there is added a surface charge $Q_{12}$ for increasing the threshold voltage of transistor $T_2$.

With (19) also $W_1$ and $W_2$ can be written as follows:

$$W_1 = \frac{1}{b_1 + 1}\,[U_{DD} + U_{BO} + U_{TO}\cdot(b_1 - 1)] \quad (20)$$

$$W_2 = U_{DD} + U_{BO} + U_{TO}\cdot(b_2 - 1) + b_2\left(\frac{Q_{I2}}{Cox} - U_1\right) \quad (21)$$

Calculation of the constant current $I_K$:

$$I_K = \frac{k}{2}\,(U_2 - U_{TO})^2 \quad (22)$$

$$I_K = \frac{k}{2}\,U_{GSeff2} \quad (23)$$

as long as $U_2 - U_{TO} < U_3$ with $$U_{GSeff} = U_2 - U_{TO} \quad (24)$$

The dependence of the constant current $I_K$ upon the surface charge density is as follows:

$$\frac{dI_K}{dQ_{SS}} = \frac{dI_K}{dU_{GSeff}}\cdot\frac{dU_{FSeff}}{dU_{TO}}\cdot\frac{dU_{TO}}{dQ_{SS}} = \frac{-\beta_K}{+Cox}\,U_{GSeff}\cdot\left(\frac{dU_2}{dU_{TO}} - 1\right) \quad (25)$$

(−for $n$-channel +for $p$-channel)

The dependence of the constant current $I_K$ upon the supply voltage $U_{DD}$ is calculated as follows:

$$\frac{dI_K}{dU_{DD}} = \frac{dI_K}{dU_{GSeff}}\cdot\frac{dU_{GSeff}}{dU_{DD}} = \beta_K\,U_{GSeff}\cdot\frac{dU_2}{dU_{DD}} \quad (26)$$

It can be shown that $$\frac{dU_2}{dU_{TO}} = (1 - K_{20})\cdot\left[b_2 - 1 - b_2\frac{b_1 - 1}{b_1 + 1}\cdot(1 - K_{10})\right] \quad (27)$$

and $$\frac{dU_2}{dU_{DD}} = (1 - K_{20})\cdot\left[1 - \frac{b_2}{b_1 + 1}\cdot(1 - K_{10})\right] \quad (28)$$

by using the abbreviations $$K_{10} = \frac{U_{B1}/4\phi_F}{\sqrt{1 + \frac{W_1}{2\phi_F} + \left(\frac{U_{B1}}{4\phi_F}\right)^2}} \text{ and}$$

$$K_{20} = \frac{U_{B0}/4\phi_F}{\sqrt{1 + \frac{W_2}{2\phi_F} + \left(\frac{U_{B0}}{4\phi_F}\right)^2}}$$

From (25) and (27) it will be seen that $$\frac{dI_K}{dQ_{SS}} = 0, \text{ when}$$

$$[1 - K_{20}(b_2)]\cdot\left\{b_2 - 1 - b_2\frac{b_1 - 1}{b_1 + 1}\,[1 - K_{10}(b_1)]\right\} = 1 \quad (29)$$

And from (26) and (28) it will be seen that $$\frac{dI_K}{dU_{DD}} = 0, \text{ when}$$

$$1 - \frac{b_2}{b_1 + 1}\,[1 - K_{10}(b_1)] = 0 \quad (30)$$

Both relationships are simplified considerably with respect to $b_1 = 1$ $$\frac{dI_K}{dQ_{SS}} = 0, \text{ when } [1 - K_{20}(b_2)]\cdot(b_2 - 1) = 1 \quad (31)$$

$$\frac{dI_K}{dQ_{DD}} = 0, \text{ when } 1 - \frac{b_2}{2}\cdot[1 - K_{10}(1)] = 0 \quad (32)$$

From (32) it follows that:

$$b_2 = \frac{2}{1 - K_{10}(1)}$$

and (31) becomes the conditional equation for $Q_{I2}$. A definite calculation shows that the saturation requirement (12$a$) and simultaneously, (31) can only be satisfied exactly when there is provided for a sufficiently high surface charge $Q_{12}$ by way of ion implantation. The calculation also shows that even in the case of a non-optimal $Q_{I2}$, the dependence $dI_K/U_{DD}$ will remain very small, and that $dI_K/dQ_{SS}=0$ can be achieved. It was found that the results of extensive computer calculations can be reconstructed by two relatively simple approximate equations, with a good accuracy.

The following Table contains an exact instruction relating to the selection of the parameters in the approximate equations shown above the Table, for determining the relationship $b_2$ and the implantation dose $Q_{I2}/q$ for the transistor $T_2$ under the condition that $b_1$ is chosen to equal 1:

$$b_2 = \sqrt{\frac{2}{L2}} = 2 + 0{,}328\cdot\left(\frac{/U_{dd}/}{15V}\right) - 0{,}487\cdot\left(\frac{N}{10^{16}\text{cm}^{-3}}\right)\alpha$$

$$\frac{\frac{1}{q}\,Q_{I2}}{10^{11}\text{cm}^{-2}} = x_o + \left(\frac{1}{k}\log\frac{N_o}{N}\right) +$$

-continued $$\frac{\frac{/U_{DD}/}{\text{Volt}} - 15}{a_1 + b_1 \log \frac{N}{10^{16}\text{cm}^{-3}}} + \frac{\frac{1}{q}\,\overline{Q_{SS}}\,/(10^{11}\text{cm}^{-2})}{a_2 + b_2 \log \frac{N}{10^{16}\text{cm}^{-3}}}$$

TABLE 1

| Substrate Doping N / cm$^{-3}$ | Channel Type | Parameters for $Q_{I2}$: No / cm$^{-3}$ | $x_o$ | K | $a_1$ | $b_1$ | $a_2$ | $b_2$ | ... for $b_2$ $\alpha$ |
|---|---|---|---|---|---|---|---|---|---|
| $10^{15}$... $10^{16}$ | p | $1.42 \times 10^{16}$ | 3.41 | 0.1357 | 0.505 | −0.06 | −0.517 | −0.048 | 0.522 |
| | n | $1.21 \times 10^{16}$ | 5.30 | 0.1915 | 0.500 | −0.020 | +0.517 | +0.048 | |
| $10^{16}$... $6 \times 10^{16}$ | p | $8.50 \times 10^{16}$ | −2.86 | 0.01735 | 0.505 | −0.032 | −0.517 | −0.105 | 0.572 |
| | n | $7.29 \times 10^{16}$ | −0.414 | 0.02158 | 0.505 | −0.035 | +0.517 | +0.105 | |

What is claimed is:

1. A monolithically integrated circuit for an IGFET-constant current source containing a source-drain series arrangement of two IGFET's of one conductivity type in series between the voltage supply and the substrate, in which series arrangement the gate electrode of the first load IGFET of the series arrangement, as applied to the first pole of the voltage supply, is connected to the first pole of the voltage supply, and the common connection point of the two IGFET's is connected to the gate electrode of a current-source IGFET whose source electrode is applied to the substrate, wherein the improvement comprises that:

when using enhancement IGFET's of the same channel conductivity type, the gate electrode of the second IGFET ($T_2$) of the series arrangement is connected to the common connection point (1) of a further source-drain series arrangement of two IGFET's ($TL_1$, $T_1$) arranged in series between the first pole and the substrate, that in the further source-drain series arrangement, the gate electrode of the load-IGFET ($T_{L1}$) as applied to the first pole of the supply voltage ($U_{DD}$) is applied to this first pole of the voltage supply ($U_{DD}$), and that the gate electrode of the second IGFET ($T_1$) is applied to the common connection point (1) thereof, and that the condition $(\beta_1/\beta_{L1})=1$ is extensively approximated and that the condition $4<\beta_2/\beta_{L2}\leqq 9$ is satisfied.

wherein $\beta_1$ indicates the mutual conductance constant of the second IGFET ($T_1$) of said further series arrangement, wherein $\beta_{L1}$ indicates the mutual conductance constant of the load-IGFET of said further series arrangement, wherein $\beta_2$ indicates the mutual conductance constant of the second IGFET ($T_2$) of the series arrangement, and wherein $\beta_{L2}$ indicates the mutual conductance constant of the load-IGFET of the series arrangement.

2. The monolithically integrated circuit as claimed in claim 1, in that the doping concentration directly on the semiconductor surface within the channel region below the gate-insulating layer of the IGFET ($T_2$) of the series arrangement ($T_2$, $T_{L2}$) on the substrate side, is purposely varied with respect to its original value, i.e. with respect to the substrate surface concentration of the channel regions of the remaining transistors.

3. The monolithically integrated circuit as claimed in claim 2, in that the doping concentration within the channel region of the substrate-sided IGFET ($T_2$) below the gate-insulating layer is varied down to a maximum depth of $10^{-5}$ cm.

4. The monolithically integrated circuit as claimed in claims 1, 2 or 3, in that the substrate surface concentration within the channel region of $T_2$ is varied by way of ion implantation.

* * * * *